United States Patent [19]

Showers

[11] Patent Number: 4,573,940

[45] Date of Patent: Mar. 4, 1986

[54] DOLL AND MEANS FOR STANDING SAME

[76] Inventor: Robert A. Showers, 325 E. Third, Alton, Ill. 62002

[21] Appl. No.: 602,810

[22] Filed: Apr. 23, 1984

[51] Int. Cl.[4] ..... A63H 3/46

[52] U.S. Cl. ..... 446/376; 128/80 R; 446/390

[58] Field of Search ..... 446/268, 285, 369, 370, 446/371, 279, 372, 376, 382, 390; 128/80 R, 80 A, 83.5; 248/175, 176

[56] References Cited

U.S. PATENT DOCUMENTS

| | | | |
|---|---|---|---|
| 232,403 | 9/1880 | Herrick | 248/175 |
| 569,333 | 10/1896 | Hinckley | 446/279 |
| 874,446 | 12/1907 | Slater | 128/83.5 |
| 1,355,789 | 10/1920 | Williamson | 446/285 |
| 1,451,390 | 4/1923 | Hendrix | 446/285 |
| 1,960,981 | 5/1934 | Stocker | 446/285 |
| 3,750,359 | 8/1973 | Loomans | 128/80 R |
| 3,987,582 | 10/1976 | Williams | 446/268 |

FOREIGN PATENT DOCUMENTS

| | | | |
|---|---|---|---|
| 406380 | 9/1970 | Australia | 128/80 R |
| 85411 | 4/1895 | Fed. Rep. of Germany | 446/285 |

*Primary Examiner*—F. Barry Shay
*Attorney, Agent, or Firm*—Kalish & Gilster

[57] ABSTRACT

A doll stand imparts to a doll inflexibility of its legs relative to its torso. The stand includes left and right leg-brace elements having a length at least as great as the doll's legs and carrying at their lower ends independent ankle-engaging stirrup-shaped fixtures for independently engaging the doll's ankles. A waist-securement loop is connected to the upper ends of said leg-brace elements for their mutual securement to the torso of the doll and for maintaining the leg base elements along the doll's legs for preventing bending. With the stand used, the doll is maintained in a stiff-legged position for causing it to remain standing.

7 Claims, 6 Drawing Figures

DOLL AND MEANS FOR STANDING SAME

BACKGROUND AND SUMMARY OF THE INVENTION

This invention relates to dolls, and more specifically, to a doll stand for supporting a doll to maintain it in a standing posture and for general display thereof.

Years ago, dolls were manufactured with flexible body members, as by being, for example, of stuffed fabric construction or else having a more or less rigid torso to which the legs were flexibly attached. In recent years, doll manufacture has seen the increasing use of plastics and synthetic materials to provide relatively rigid constructions allowing the legs and other body members to be re-oriented by the user and even to permit the doll to stand on its own feet. However, there recently has been extraordinary commerical success for a more primitive, fabric type of doll having the homespun, fundamentally homely character of earlier dolls which, because of the flexibility and general materials of constructions, are not ordinarily self-supporting and will not permit the legs to remain in a desired position. If the owner of the doll wishes to have the doll in a standing position, use must be made of a doll stand. For example, collectors prefer sometimes to have dolls in a standing position on shelves; and a child may prefer to have the doll stand as would a real person.

Heretofore, there have been proposed doll stands as in Williams U.S. Pat. No. 3,987,582 wherein there is proposed to provide a base for ground support having a pair of upright members extending in front of and behind the doll which, in the case of a skirted doll, would conceal portions of the stand.

Also, in Hall U.S. Pat. No. 3,516,632, there is proposed a doll stand having a base for floor support to which upright extends between the legs of the doll and with clamping members at the upper end of such vertical support for engaging body portions of the doll. Such constructions are representative of the prior art of doll stands, as to which the general concept goes back to the very early McCutchins U.S. Pat. No. 180,613, which issued in 1976, and Schilling U.S. Pat. No. 425,709, which issued in 1890.

All these prior art constructions support the doll by a base or members of the stand which contact the floor. An objection to such prior art constructions is that portions of the doll stand are visible and even unattractive and rob from the realism which would be obtained if the doll were able to stand in an apparent self-supporting manner.

It is an object of the present invention to provide a doll stand for use with a doll having intrinsically flexible characteristics and adapted for being attached to the doll whereby when so utilized the doll is caused to remain in an apparently self-supporting, standing, or other stiff-legged position.

Another object of the present invention is to provide such a doll stand which is concealed from view when so attached to a doll, conducing to a realism for the doll which has not been heretofore available in prior art doll stand constructions. Yet another object of the invention is to provide such a doll stand which is very readily and easily attached to a doll, as by a young child and when so attached, will reliably remain affixed to the doll throughout rough play and usage, and is safe in use.

Briefly, a doll stand in accordance with the invention imparts to the doll an inflexible nature of the doll's legs relative to its torso. The stand includes left and right leg brace elements having a length at least as great as the dolls legs and carrying at their lower ends independent ankle-engaging means for independently engaging the doll's ankles. A waist-securement means is connected to the upper ends of said legs brace elements for mutual securement thereof to the waist of the doll and for maintaining the leg base elements along the doll's legs for preventing bending. Accordingly, the doll is maintained in a stiff-legged position for causing it to remain in a self-supported, standing orientation.

Other objects and features will be in part apparent and in part pointed out hereinbelow.

BRIEF DESCRIPTION OF THE DRAWINGS

Corresponding reference characters include corresponding parts throughout the several views of the drawings.

DESCRIPTION OF THE PREFERRED EMBODIMENT

Figure 1:
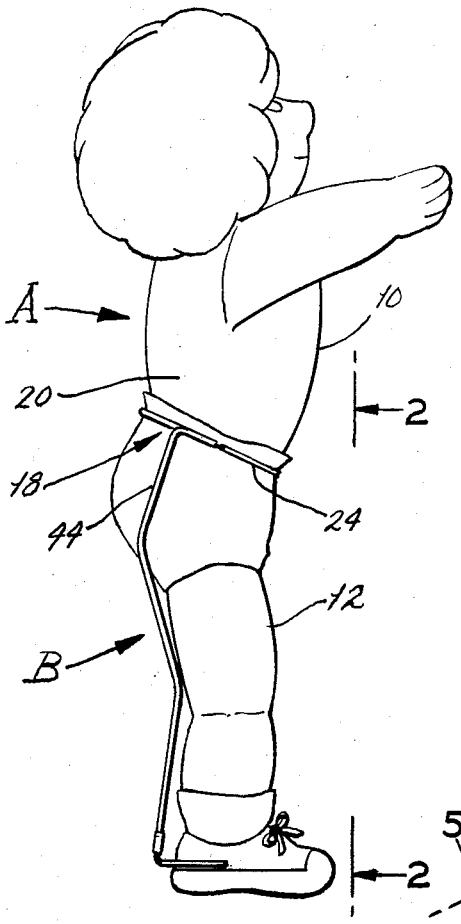
FIG. 1 is a side elevation view of a doll supported in a stiff-legged standing position by a doll stand in accordance with and embodying the present invention.

Referring now by reference characters to the drawings, designated generally at A is a doll of the type having a torso 10 to which each leg 12 is flexibly attached, the leg components being thereby intrinsically flexible, for permitting the legs to be raised, as for seating the doll, or extended as depicted in FIG. 1. Thus, by flexible leg components, it is meant that the legs of doll A may move relative to its torso 10 and whereby the doll is not independently self-supporting and will not stand reliably on its own.

Designated generally at B is a doll stand in accordance with the invention, which is shown attached to doll A for the purpose of imparting to doll's legs an inflexible nature relative to its torso 12 for allowing the doll to maintain a stiff-legged condition permitting it to remain in an apparently self-supported, standing position as depicted in FIG. 1.

Figure 2:
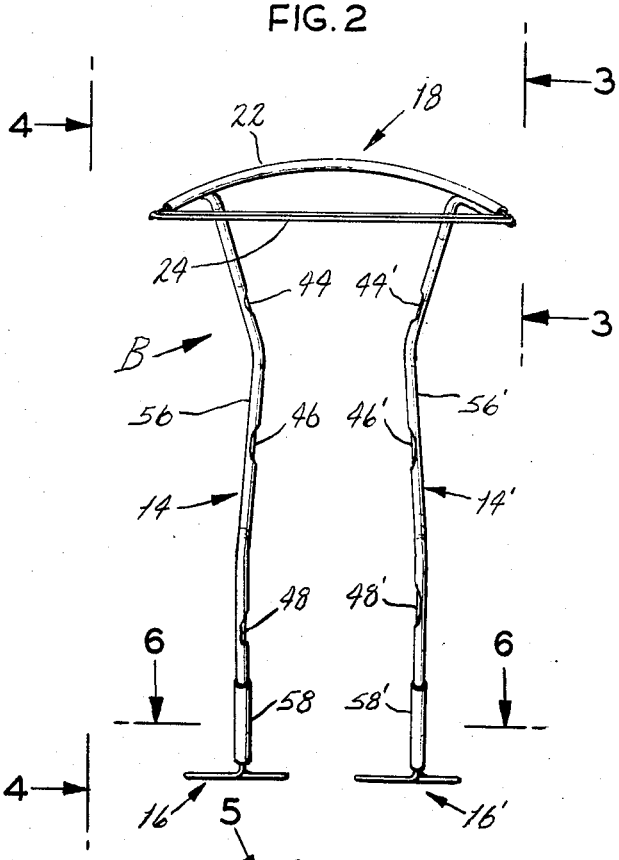
FIG. 2 is a front elevation view of the doll stand.
Figure 3:
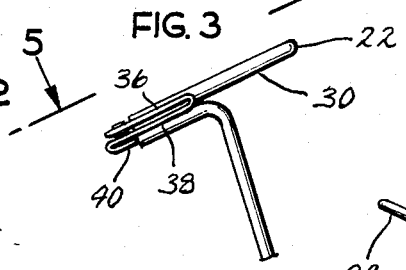
FIG. 3 is a fragmentary left elevation view of the doll stand without the doll as taken along line 3—3 of FIG. 2.

Referring to FIG. 2, doll stand B comprises a pair of leg brace elements, generally designated 14, 14' for the left and right legs, respectively of the doll, being each at least as great as and preferrably slightly longer than the legs of the doll, as shown in FIG. 1. At the lower ends of leg brace elements 14, 14' are respective ankle-engaging means generally designated 15, 15' for independently engaging the ankles of the doll. Said leg elements 14, 14' extend downwardly from waist securement means, generally designated 18, by which doll stand B is adapted to be secured to the torso 10 or waist portion 20 as shown in FIG. 1.

Said waist securement means 18 more specifically comprises a curved, arcuate, back piece 22 having the general shape of an arc sector or circular shape whereby it will conform to generally rounded configuration of the doll's waist 20, and across the front of which is an elastic band 24 for elastic, reliable securement to the doll.

Turning now to FIGS. 3–6, the specific construction of the new doll stand B is more clearly revealed in detail. Thus, according to a presently preferred form of construction, the entire structure of doll stand B is formed of a single length of wire, the opposite ends of which terminate as at 26, 26' rearwardly of ghe heel- or ankle-engaging means 16, 16'. The wire may be of galvanized steel, aluminim or the like, being stiffly resilient yet bendable if desired for better accommodation to a specific doll.

Figure 5:
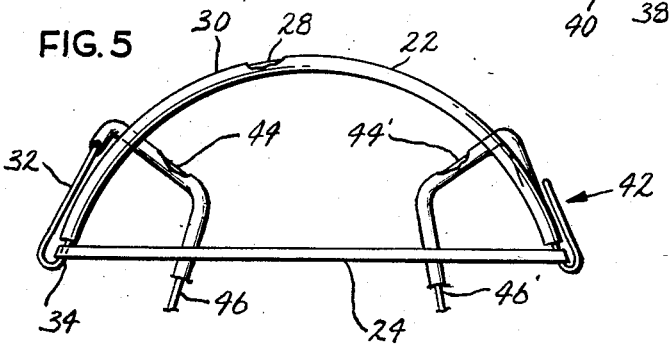
FIG. 5 is a fragmentary top plan view of the doll stand.
Figure 4:
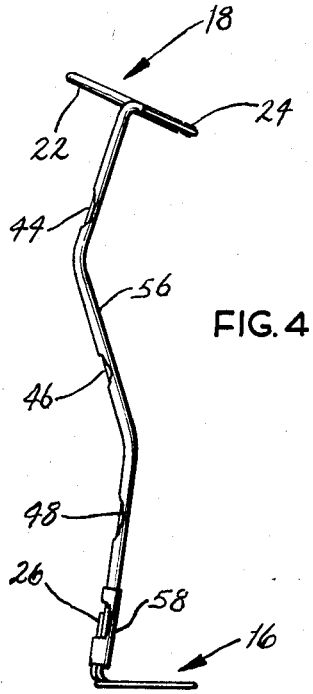
FIG. 4 is a right side elevation view of the doll stand without the doll as taken generally along line 4—4 of FIG. 2.

Referring to FIG. 5, a segment 28 forms back piece 22, preferrably being covered by a length 30 of resilient plastic or rubber tubing for providing a soft, protective and yet friction-increasing surface covering. At opposite ends of said wire segment 28, it is folded rearwardly, as at 32, on the right side to form a loop or bight 34 through which said elastic band 24 is passed and held captive. At the left side of the construction, wire segment 28 is bent rearwardly as a short segment 36 folded forwardly back upon itself as another short segment 38 which, in turn, is again rearwardly folded as at 40 to provide a segment generally corresponding to that designated at 32. Thus, segments 36, 38 together form a hook generally designated 42 lying along and proximate the left side of back piece 22 for providing a readily detachable point of engagement for the left side of band 24.

Leg brace elements 14, 14' are formed as continuous extensions of such wire downwardly, each having rearwardly and inwardly directed straight upper segments 44, 44' which lie along the buttocks of the doll (see FIG. 1) and which at their lower ends join forwardly and slightly outwardly diverging segments 46, 46', also of straight character, which lie rearwardly of the legs of the doll and which join slightly rearwardly, essentially parallel lower segments 48, 48' which are intended to lie rearwardly at the lower leg portions of the doll, segments 48, 48' at their lower ends carry said ankle-engaging means 16, 16'.

Figure 6:
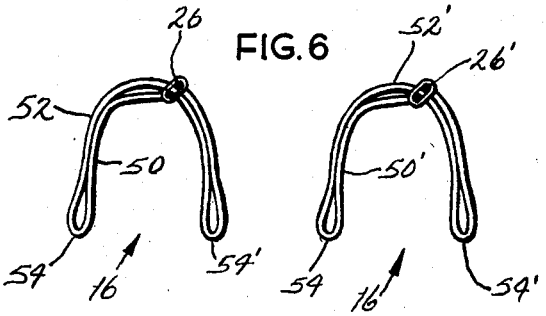
FIG. 6 is a horizontal cross section generally taken along line 6—6 of FIG. 2.

The latter are seen in FIG. 6 also to be formed of such length of wire continued, however, as segments 50, 50' upon which are folded back further segments 52, 52' whereby there are formed stirrup-like constructions having blunt outer ends, as at 54, 54', and defining forwardly opening recesses which will receive and engage the ankles of the doll, as shown in FIG. 1.

The entire length of the wire segment forming leg brace elements 14, 14' are covered by single respective lengths 56, 56' of resilient tubing like that covering wire segment 28 of the waist-engaging means 18, there being short additional length 58, 58' of such tubing at the lower ends of the leg brace elements 14, 14' protectively covering the opposite ends 26, 26' of the wire so utilized.

There is thus provided an integral construction utilizing the simplest of materials and yet forming a strong, easily manufactured construction having appropriate geometry for close conformance with the body and leg components of the doll. Thus, when elastic band 24 is extended around the front of the doll's waist and secured to said hook 42, the back piece 22 is tightly clamped to the doll and the leg brace elements 14, 14' lie in supportive orientation rearwardly and along the lengths of the legs, being independently secured to the ankles of the doll or about corresponding portions of its shoes, etc., by said ankle-engaging means 16, 16'. When so utilized with a doll A as in FIG. 1, doll stand B has its leg brace elements 14, 14' maintained along the doll's legs for preventing their bending relative to the doll's torso and whereby the doll is maintained in a stiff-legged condition causing it to remain in a standing, apparently self-supported orientation.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. In combination with a doll having intrinsically flexible leg components permitting the doll's legs to move relative to its torso, a doll stand detachably securable to said doll and including means for extrinsically maintaining the doll legs in inflexible condition relative to its torso, and comprising:

left and right relatively rigid leg-brace elements having a length at least as great as the doll's legs, independent respective, ankle-engaging means carried at the lower ends of the leg-brace elements for independently attaching to ankles of the doll, and torso securement means interconnected with the upper ends of each of the leg-brace elements for mutual securement thereof to the torso of the doll and for maintaining the respective leg-brace elements along the doll's legs for preventing bending thereof relative to its torso, said leg-brace elements extending downwardly from said torso securement means at the back of the respective doll legs so as to be visibly obscured from the front of the doll, whereby the doll is maintained in stiff-legged condition for permitting it to remain in a self-supported, standing position with its weight resting on its feet.

2. In combination with a doll having intrinsically flexible leg components permitting the doll's legs to move relative to its torso, a doll stand detachably securable to said doll and including means for extrinsically maintaining the doll legs in inflexible condition relative to its torso, and comprising:

left and right relatively rigid leg-brace elements having a length at least as great as the doll's legs, independent respective, ankle-engaging means carried at the lower ends of the leg-brace elements for independently attaching to ankles of the doll, and torso securement means interconnected with the upper ends of each of the leg-brace elements for mutual securement thereof to the torso of the doll and for maintaining the respective leg-brace elements along the doll's legs for preventing bending thereof relative to its torso, said torso securement means comprising a relatively thin, rigid curved back piece for extension across the back of the doll at substantially waist level and a flexible element extending across the front of the doll, said back piece and leg-brace elements being formed of a single length of wire, said leg-brace elements being constituted of segments of such wire extending downwardly from opposite side portions of said back piece, whereby the doll is maintained in stiff-legged condition for permitting it to remain in a self-supported, standing position with its weight resting on its feet.

3. In combination with a doll, a doll stand according to claims 1 or 2, wherein the curved back piece and leg-brace elements are covered by flexible tubing.

4. In combination with a doll, a doll stand according to claims 1 or 2, and further characterized by the ankle-engaging means being constituted by respective stirrup-shaped segments of such wire at the lower ends of respective segments lying rearwardly of the lower legs of the doll, said stirrup-shaped segments defining ankle-receiving openings which open forwardly for receiving the ankles of the doll.

5. In combination with a doll, a doll stand according to claim 2, and further characterized by the flexible element comprising an elastic band, the back piece being configured to provide a hook at one side thereof for detachable engagement of the elastic band.

6. In combination with a doll, a doll stand according to claim 2, and further characterized by the leg brace elements being formed of different segments lying rearwardly of the respective legs and lower legs of the doll, and further portions overlying the buttocks of the doll.

7. In combination with a doll having intrinsically flexible leg components permitting the doll's legs to move relative to its torso, a doll stand detachably securable to said doll and including means for extrinsically maintaining the doll legs in inflexible condition relative to its torso, and comprising:

left and right relatively rigid leg-brace elements having a length at least as great as the doll's legs, torso securement means interconnected with the upper ends of each of the leg-torso elements for mutual securement thereof to the torso of the doll and for maintaining the respective leg-brace elements along the doll's legs for preventing bending thereof relative to its torso, ankle-engaging means carried at the lower end of each of the leg-brace elements spacedly upwardly from the bottom of the feet of the doll for independently attaching to ankles of the doll, whereby the doll, by means of said leg-brace elements and ankle engaging means is maintained in stiff-legged condition permitting it to remain in a self-supported standing position with its weight resting entirely on its feet.

* * * * *

UNITED STATES PATENT AND TRADEMARK OFFICE

CERTIFICATE OF CORRECTION

PATENT NO. : 4,573,940

DATED : March 4, 1986

INVENTOR(S) : Robert A. Showers

It is certified that error appears in the above-identified patent and that said Letters Patent is hereby corrected as shown below:

Column 6, line 10, change "torso" to ---brace---.

Signed and Sealed this

*Thirteenth* Day of *May 1986*

[SEAL]

*Attest:*

DONALD J. QUIGG

*Attesting Officer*

*Commissioner of Patents and Trademarks*